United States Patent [19]

MacElvain

[11] 4,214,984

[45] Jul. 29, 1980

[54] MAGNETIC SEPARATION

[76] Inventor: Robert C. MacElvain, 725 N. Randolph Ave., Eufaula, Ala. 36027

[21] Appl. No.: 816,029

[22] Filed: Jul. 15, 1977

[51] Int. Cl.[2] ..... B03C 1/22

[52] U.S. Cl. ..... 209/214; 209/223 R; 209/225

[58] Field of Search ..... 209/8, 40, 39, 213, 209/214, 216, 223, 231, 232, 224–226, 230; 210/222–223; 335/305

[56] References Cited

U.S. PATENT DOCUMENTS

| | | | |
|---|---|---|---|
| 455,985 | 7/1891 | Fiske | 209/226 |
| 3,289,836 | 12/1966 | Weston | 209/227 |
| 3,850,811 | 11/1974 | Wheelock | 210/223 |
| 4,003,830 | 1/1977 | Schloemann | 209/223 R |

FOREIGN PATENT DOCUMENTS

| | | | |
|---|---|---|---|
| 684279 | 12/1952 | United Kingdom | 209/223 |

OTHER PUBLICATIONS

Magnetic Separation of Ores, U.S. Bureau of Mines, Bulletin 425.

Handbook of Mineral Dressing, Taggart, 1927, John Wiley and Sons, Inc.

Hackh's Chemical Dictionary, 3rd Edition, Julius Grant, McGraw-Hill Book Co., Inc.

*Primary Examiner*—Ralph J. Hill

*Attorney, Agent, or Firm*—Sheridan, Ross, Fields & McIntosh

[57] ABSTRACT

A process is disclosed for separating a relatively more magnetic material from a relatively less magnetic material comprising passing the material being processed through a plurality of regions, each region having a relatively more magnetic segment and a relatively less magnetic segment, such that the plurality of regions are arranged so as to comprise alternating relatively more magnetic and relatively less magnetic segments, which regions are aligned at an angle other than 90° in the plane of the surface of the regions to the direction of the resultant nonmagnetic forces such that the relatively more magnetic material has a tendency to travel at an angle to the direction of flow of the relatively less magnetic material thereby effecting the separation. Preferably each of the regions is aligned from 0° to about 30° with respect to each adjacent region.

81 Claims, 16 Drawing Figures

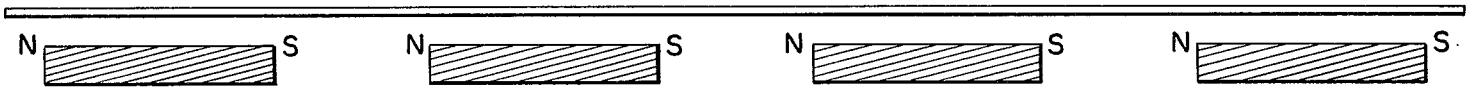
FIG. 2A
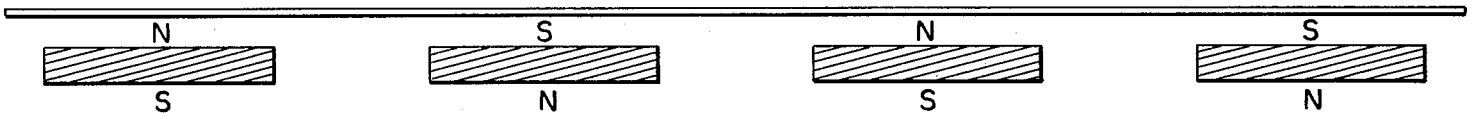
FIG. 2B
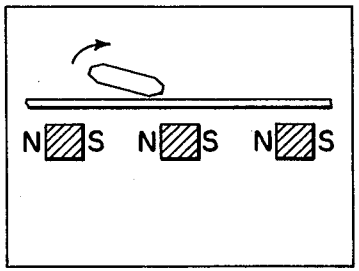
FIG. 3A
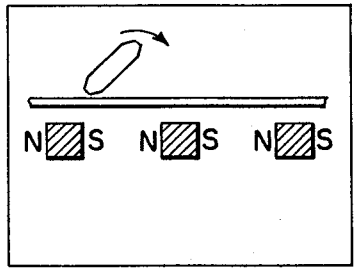
FIG. 3B
FIG. 3C
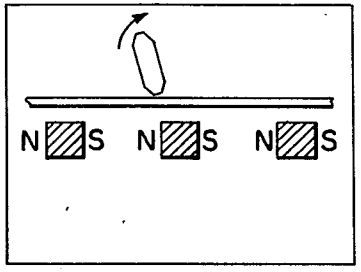
FIG. 3D

MAGNETIC SEPARATION

BACKGROUND OF THE INVENTION

1. Field of the Invention

This invention relates to the separation of one substance from another based on their differing magnetic susceptibilities.

2. The Prior Art

Magnetic separations are, of course, widely employed for many different applications, using many different specific techniques. In theory, the interaction of a substance with a magnetic field determines whether it is defined as a paramagnetic or diamagnetic substance. Paramagnetic substances concentrate or draw within themselves lines of magnetic force and achieve a flux density greater than that found in the surrounding field in a vacuum. In a magnetic field the dipole (an opposing north-south pole pair within a substance) of a paramagnetic substance will experience a torque, i.e., a rotational force, which tends to align the dipole parallel to the magnetic lines of force. If the field is nonuniform, that is, one where the field intensity or flux density varies with distance, then what is known as a tractive force will be exerted in the direction of increasing field strength.

For diamagnetic substances in a magnetic field, the interactions are the opposite. The magnetic lines of force are diverged within the substance; thus, it contains a flux density less than the surrounding field. The rotational force tends to align the substance perpendicular to the magnetic lines of force. The tractive force is in a direction toward decreasing field strength.

The rotational force or torque exerted on a substance in a magnetic field is a product of the pole strength, the distance between poles and the field strength. The tractive force is a product of the mass of the particle, its magnetic susceptibility, the field strength, and the magnetic gradient. The tractive force for ferromagnetics, an important subclass of paramagnetics, follows the above guidelines; however, the magnetic susceptibility of ferromagnetic materials is a complex function of the field strength.

Magnetic separation, which is widely used to beneficiate ores divides the feed material into at least two products: more magnetic, sometimes called "magnetic", and less magnetic, sometimes called "nonmagnetic". In today's commerce, only paramagnetic substances are removed from the feed into the "magnetic" fraction, and the primary force used to withdraw this "magnetic" fraction is the tractive force.

For a separation of "magnetics" from "nonmagnetics", feed material is transported through a nonuniform magnetic field, i.e., a field with a gradient. There, the magnetic separation of discrete particles occurs based upon a three-way competition between the magnetic; gravitational, frictional, hydraulic, inertial, and other forces; and interparticle forces.

The magnetic force (tractive) to move a susceptible particle away from other particles can be increased by increasing the field strength or increasing the field gradient. The magnetic fields of magnetic separators of low intensity (a few kilogauss or less) usually are produced by permanent magnets; high intensity fields up to 20 kilogauss (sometimes greater with superconducting systems) are produced by electromagnets. Low gradients result from specially shaped pole pieces. High gradients are obtained by packing a matrix of filamentary ferromagnetic material in a magnetized volume; high field gradients result at the edges of the filaments.

Interparticle forces may be magnetic in origin. They arise because a paramagnetic particle in a magnetic field concentrates lines of force; it therefore acts as a magnet with respect to a second susceptible particle because it converges the field. The net effect is the aggregation or flocculation of magnetic particles, particularly if the particles are small, if the magnetic susceptibility is large, and if the field is intense.

There are several types of magnetic separators used for beneficiating ores, including, for example, drum separators, induced roll separators, and crossbelt separators. Drum separators contain stationary electromagnets or permanent magnets inside rotating drums. Feed material is introduced onto the top of the drum. The magnetic force holds the magnetic particles to the drum until rotation of the drum carries the magnetics past the point where nonmagnetics fall away from the drum. The magnetics are released when they pass the point where the magnet ends. With this type of separator, the complete separation must occur in the short time it takes for the particles to pass over about 90° arc of the drum. Induced roll separators acquire the magnetic force on the roll through induction from a large electromagnet. The roll is comprised of laminae alternately of magnetically permeable and impermeable material. As a result, the permeable laminae acquire an induced field, and a gradient develops between adjacent permeable laminae which then produces a tractive force upon susceptible particles passing over the roll. Nonmagnetics fall free from the roll; magnetics are retained upon the roll until brushed free on the back side of the roll. Thus the induced roll, like the drum separator, can provide only a short time for separation. However, for the induced roll the time is even shorter since induced rolls are typically five inches in diameter, while drum separators are typically 36 inches in diameter. The crossbelt separator consists of a main feed belt which passes beneath one or two magnets with a strongly converging field. Susceptible particles are drawn up toward the magnet but intercepted on the bottom of a crossbelt moving perpendicularly to the feed belt and located below the top pole of the magnet but above the feed particles. This crossbelt removes magnetics from the feed material and the magnets of the separator. All of the separation between particles must occur in the short time it takes for a particle on the feed belt to pass beneath the crossbelt, and although two crossbelts are frequently employed, the requirement of having a practical throughput demands a fast moving feed belt, hence a short time in the magnetic field.

Several patents discuss more specific techniques for accomplishing magnetic separations, including U.S. Pat. No. 3,725,262. The process disclosed in this reference sets forth a technique for reclaiming a contaminated liquid-solid mixture, which in part includes a magnetic separation over a region which contains a series of bar magnets arranged in a pattern to permit the magnetic particles to adhere to the regions of strongest magnetic intensity. In a process for separating nonferromagnetic, conductive metals from nonferromagnetic, nonconductive materials, U.S. Pat. No. 4,003,830 discloses in part the use of a herringbone-shaped pattern of magnets with alternating polarities arranged such that eddy currents are produced in the magnetic field. The result is a rather complex force field which affects the conductive nonmagnetic portion of the material being processed in a manner such that it is driven in an opposite direction to the flow of the resulting material.

A major disadvantage of many such magnetic separators is the short time available for the magnetic force to act upon and separate the more magnetic particles. As is discussed by Gaudin in *Principles of Mineral Dressing*, McGraw-Hill Book Co., N.Y., N.Y., 1939, p. 441, if the operation of a magnetic separator is to be continuous, the process must be carried out on a stream of particles passing into and through a magnetic field. The duration of application of the field is therefore limited to a short time, usually a fraction of one second. Gaudin comments further that by reducing the rate of passage of particles, it is possible to affect less susceptible particles. Information on this time effect, and additionally the effect of preliminary magnetization, is presented in U.S. Bureau of Mines R.I. 6411, wherein it is pointed out that the magnetic tractive force on particles varies not only in accordance with the static susceptibility but also with respect to magnetization in a preliminary field and time of retention in the tractive field.

The problem of entrapment of nonmagnetics in magnetics is also a major disadvantage to an effective magnetic separation. The phenomenon is addressed by Gaudin, supra, p. 441, wherein it is pointed out that occlusion of nonmagnetic material within magnetic flocs is especially serious in dry separators working on fine, highly magnetic material. It is further stated that this is caused in part by a sudden rush of the highly magnetic material toward the zone in the field that has the highest density, and in part by the instant formation of chains and flocs of magnetized particles which occlude and entrap nonmagnetic particles.

The process of the present invention obviates these disadvantages permitting the material being treated to be acted upon in the magnetic field for virtually an indefinite period of time. Furthermore, the magnetic force exerted by the magnetic field arrangement of the invention produces a tumbling effect as a result of the realignment of the magnetic particles to alternating opposing particles, thereby freeing the nonmagnetic particles from entrapment by magnetic particles.

SUMMARY OF THE INVENTION

A process is disclosed for separating a relatively more magnetic material from a relatively less magnetic material comprising passing the material being processed through a plurality of regions, each region having a relatively more magnetic segment and a relatively less magnetic segment, such that the plurality of regions are arranged so as to comprise alternating relatively more magnetic and relatively less magnetic segments, and which regions are aligned at an angle of other than 90° in the plane of the surface of the regions to the direction of the resultant nonmagnetic force, such that the relatively more magnetic material has a tendency to travel at an angle to the direction of flow of the relatively less magnetic material thereby effecting the separation. Preferably each of the regions is aligned from 0° to about 30° with respect to each adjacent region, and the edge of each magnetic segment is of opposite polarity with respect to the edges of each adjacent magnetic segment.

The material being processed may be moved through the magnetic field by any convenient technique, such as, for example, a horizontally-arranged conveyor system. Further, numerous different patterns may be employed in the arrangement of the magnetic regions in order to facilitate the accommodation of different materials being processed.

BRIEF DESCRIPTION OF THE DRAWINGS

FIGS. 2A and 2B illustrate two different magnetic arrangements in order to achieve opposite polarity, as is hereinafter more fully discussed.

FIGS. 3A through 3D illustrate one means of a motion of a particle travelling through a plurality of regions in accordance with the invention, the particular motion illustrated being that of a tumbling motion.

DESCRIPTION OF THE PREFERRED EMBODIMENTS

Figure 1:
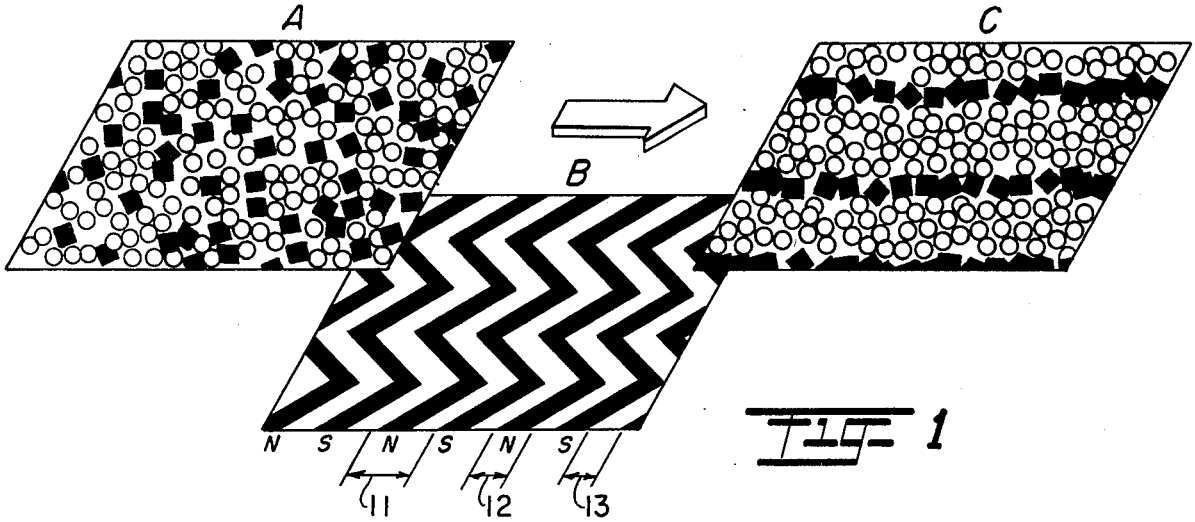
FIG. 1 illustrates a sequential depictation of a material being treated by the process of the invention and its subsequent separation, the pattern illustrated being that of a herringbone.

The process of the present invention accomplishes a separation of a relatively more magnetic material from a relatively less magnetic material by passing the material through a plurality of regions, each region being comprised of a relatively strong magnetic segment and a relatively weak magnetic segment such that the plurality of regions in its entirety consists of alternating relatively strong magnetic segments and relatively weak magnetic segments. These regions are aligned at an angle other than 90° in the plane of the surface of the regions to the direction of the resultant nonmagnetic force, thereby creating a force tending to drive the magnetic portion of the material in an angular direction in relationship to the direction of flow of the nonmagnetic material. By properly spacing the relative widths of the segments, and by arranging the magnetic segments such that the edges of each magnetic segment are of opposite polarity with respect to the edges of its adjacent magnetic segments, the magnetic particles are not only driven in an angular direction but "flip-flop" upon travelling through each region. This flip-flop allows entrained nonmagnetic particles to be freed, thereby facilitating the separation. As is shown in FIG. 1, when a pattern such as a herringbone pattern is employed with the other elements of the process of the invention, the magnetic species (illustrated as the solid square particles) have a tendency to move towards and align themselves with the alternate apexes of the pattern, while the nonmagnetics (illustrated as circular, open particles) will travel throughout the balance of the conveying mechanism. As can be appreciated, when the material passes through a sufficient number of regions, which can virtually be indefinite in number and hence indefinite in duration of time subjected to the magnetic field, the magnetic separation can be substantially complete. Conventional separators, for example a magnetic drum, may then be employed to complete the separation much more efficiently than has heretofore been possible, with much less nonmagnetic material being entrapped with the magnetic material being separated.

By varying the available parameters as hereinafter discussed, the process of the present invention is capable of accomplishing the separation of one material from another with very little difference in the magnetic susceptibilities of the respective materials. Hence, the terminology employed of separating a "relatively strong magnetic material" from a "relatively weak magnetic material" not only encompasses the separation of a paramagnetic material from diamagnetic materials, but also includes a separation of, for example, one paramagnetic material from other paramagnetic materials, as long as there is a practical distinction in the magnetic susceptibilities of the materials. Hence, for example, pyrrhotite may be easily and conveniently separated from gangue material, and by varying such parameters as the magnetic intensity, the respective widths of the magnetic and non-magnetic segments, the angular pattern of the regions, the distance between adjacent relatively strong magnetic segments, the number of regions employed, the time within which the material is subjected to the magnetic fields, and others, pyrrhotite may be separated from, for example, pentlandite.

A few examples of ores which may be separated from gangue materials in accordance with the process of this invention include magnetite, franklinite, ilmenite, pyrrhotite, zircon, corundum, pyrolusite, columbite, tantalite, marmatite, pentlandite, spinel, garnet, wolframite, monazite, rutile, chromite, manganite, and bastnaesite.

Along with these and other minerals, numerous other compounds possess a sufficient magnetic susceptibility in order to be easily separated from relatively nonmagnetic materials. These compounds include, for example, compounds of iron, nickel, cobalt, manganese, chromium, cerium, titanium, many of the rare earth metals, oxygen, and the platinum metals.

Furthermore, techniques are available to alter the surface characteristics of compounds in order to enhance or suppress the magnetic susceptibility of such compounds. These surface altering techniques can be employed in combination with the process of the present invention to effect separations of compounds which would otherwise be very difficult to accomplish by means of magnetic techniques.

In order to accomplish the magnetic separation of one material from another, the materials must be physically liberated from each other, and therefore the invention from a practical standpoint contemplates that the solid materials to be processed would initially be crushed. The degree of crushing depends upon the values of the other parameters, but generally to be practical, the material should be no larger than about 10 centimeters, more preferably no larger than about 1.0 centimeter, and most preferably no larger than about 0.1 centimeter. While it is not necessary for the material to be dry, this condition is usually preferred. Separations employing the process of this invention can, however, be accomplished with wet material, either in wet or dry separators.

The material being processed would generally be in solid form, although gaseous separations can also be accomplished. In effecting a gaseous separation, the values of the parameters as herein discussed would be suitably modified, and of course the apparatus to be employed would have to be specifically designed in order to keep the gaseous material within the magnetic fields, and also to recover the separated gases. It is, however, possible to separate, for example, oxygen from nitrogen in air, as oxygen is relatively strongly magnetic as compared to nitrogen. Due to the practical limitations of the separation and recovery mechanisms, a complete separation would, of course, be most difficult to obtain, but certainly a partial separation is well within the practical limitations of various mechanisms.

As has frequently been alluded to, there are a number of parameters which interrelate, and this interrelationship will be apparent to one skilled in the art. Specific values for each of these parameters cannot be set forth herein under all conditions, as a variation in one parameter will have an effect on each of the other parameters. Hence, the discussion of values herein presented is intended to set forth relatively reasonable value limitations in order that the invention may be fully described, but it is clear that under proper conditions certain parameters may be well outside of the discussed values, and by proper compensation of other parameters, the effective operation of the process may still be accomplished.

The intensity of the relatively strong magnetic field must be such so as to create a force sufficient to affect the magnetic particles and must be substantially stronger than the relatively weak magnetic segments. It is generally considered that the relatively weak magnetic segments would simply be a normal weakly paramagnetic or diamagnetic material, for example, plastic, glass, paper, wood or brass, but it is apparent that as long as the difference in magnetic intensity between the relatively strong magnetic segment and the relatively weak magnetic segment is sufficient, the invention may be carried out.

It is preferred that the adjacent magnetic segments, which of course are separated by relatively nonmagnetic segments, be of opposite polarity, as is illustrated in FIGS. 2A and 2B. As is shown in the figures, this may be accomplished by either of two techniques, the arrangement of FIG. 2A and the arrangement of FIG. 2B. Either technique is suitable for the process of the invention. The result is that the magnetic particle being processed reorients itself upon approaching each successive magnetic segment, which reorientation is sometimes referred to herein as "flip-flop", one means of which is illustrated in FIGS. 3A through 3D, thereby further tending to eliminate entrained nonmagnetic particles from the magnetic particles. It is obviously not necessary that each and every magnetic segment be of opposite polarity with respect to each adjacent magnetic segment, but for optimum performance this would be preferred.

The physical size of the magnetic regions, and therefore the magnetic segments, is of considerable importance to the accomplishment of the magnetic separation. As is referred to herein, the magnetic region is defined to comprise a magnetic segment and the adjacent nonmagnetic or less magnetic segment. This is, for example, illustrated in FIG. 1 by the cross-section designated by numeral 11. The polarity shown in this figure is according to that shown in FIG. 2B. A magnetic segment is defined as one continuous magnetic portion, as for example is illustrated in FIG. 1 by the cross-section identified by numeral 12. Similarly, each relatively less magnetic or relatively nonmagnetic segment comprises one continuous area within borders of the magnetic segments, and is for example illustrated in FIG. 1 by the cross-section identified by numeral 13. As is shown throughout the figures, both the magnetic and nonmagnetic segments are preferably elongated along an axis more or less transverse to the direction of the flow of the material being processed. The extent of this elongation is not particularly critical as long as there is sufficient length so as to physically accommodate the material being processed. Also for a given cross-sectional elongated length, it is conceivable that both a magnetic segment and a nonmagnetic segment could exist, with the magnetic segment abutting the nonmagnetic segment, as long as at the abutting interface all of the segments change character from magnetic to nonmagnetic in order that the process requirements as herein discussed are maintained. In other words, as long as a reasonable length of a segment remains continuously magnetic, the segment may then switch from magnetic to nonmagnetic as long as the adjacent nonmagnetic segment in the corresponding region switches to a magnetic segment.

The respective widths of the magnetic and nonmagnetic segments are of more importance as these widths affect the strength and shape of the magnetic field acting upon a given particle. The width of a given magnetic segment is again dependent upon the overall size of the apparatus and the amount and particle size of material to be processed, and the values determined for the other parameters, and as a result can vary substantially. Preferably the width is from about 0.01 microns to about 10 centimeters, more preferably from about 0.5 microns to about 2.5 centimeters, and most preferably from about 25 microns to about 0.1 centimeters. There is no requirement that the width of one given magnetic segment be equivalent to any other magnetic segment, or that the width of a given magnetic segment be constant, although from a practical standpoint these respective widths would generally be constant.

The width of the given nonmagnetic segment is critical with respect to the lower limitation, the critical aspect being that there be sufficient width in relationship to the adjacent magnetic segments in order to permit the mechanism of the particular magnetic separation to take place. The upper width limitation is not particularly critical, but must be within practical limitations in order for the separation to be accomplished. It is therefore imperative that the width of the nonmagnetic segment be at least about 0.05 times the width of its adjacent magnetic segment. Preferably the width is at least about 0.05 to about 50, more preferably at least about 0.1 to about 5, and most preferably at least about 0.5 to about 2 times the width of the adjacent magnetic segment.

Figure 4A:
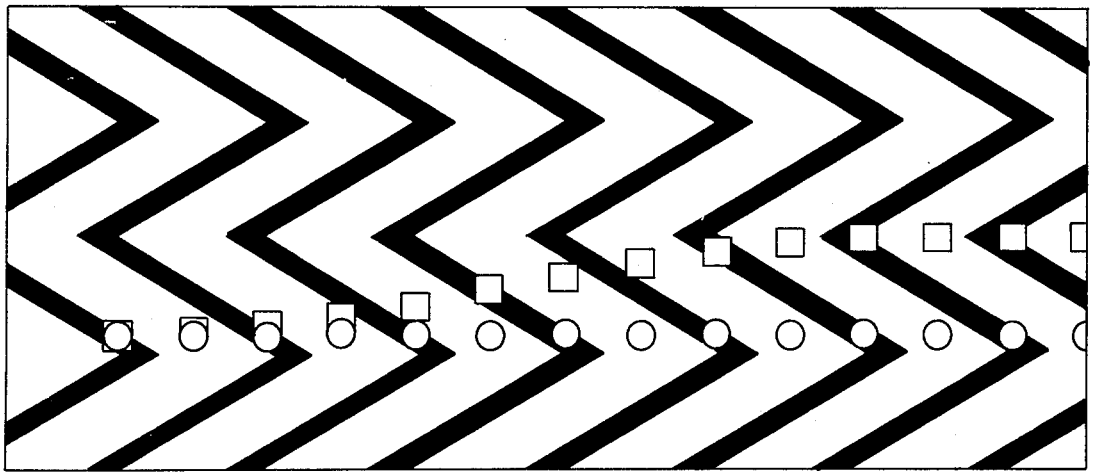
FIG. 4A illustrates a magnetic force diagram with respect to a magnetic particle, and FIG. 4B simply shows no magnetic forces acting upon a nonmagnetic particle.
Figure 4B:
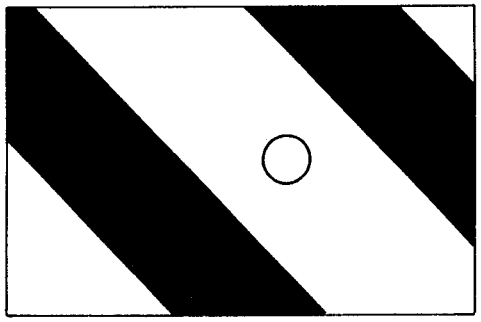
FIG. 4 illustrates in part the mechanism of the invention, with FIG. 4A showing the result of a magnetic and a nonmagnetic particle passing through a plurality of regions as herein described, the magnetic particle being illustrated as the square particle and the nonmagnetic particle being illustrated as the circular particle.
Figure 4C:
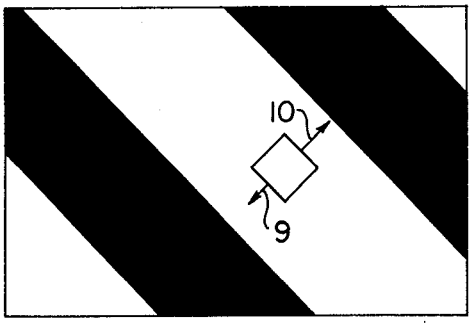

It is a requirement of the present process that there be more than one magnetic region through which the material being processed must pass. As is illustrated in FIG. 4, the mechanism is essentially such that upon travelling through each magnetic region, a magnetic particle will move at an angle, tending to travel perpendicularly toward the next magnetic segment. The result of these forces, along with the resultant nonmagnetic forces, is such that a magnetic particle, as illustrated in FIG. 4A, will tend to align itself with the alternating apexes of an angular pattern, such as the herringbone pattern illustrated, while, of course, a nonmagnetic particle will not be affected by the magnetic forces and will therefore tend to travel in the direction of the resultant nonmagnetic force. These forces are further illustrated in FIGS. 4B and 4C.

FIG. 4B basically indicates that there is no net magnetic force acting on a nonmagnetic particle. It therefore will proceed in accordance with the applied nonmagnetic forces. FIG. 4C shows two forces acting upon a magnetic particle: a net magnetic force 10 and a smaller opposing drag force 9. The resultant of these two forces tends to produce movement in the direction of the lines of magnetic force toward the next downstream segment. The motion produced by this force when combined with the motion the particle has due to the nonmagnetic forces results in a trajectory, for example, as depcited in FIG. 4A by the squares. Nonmagnetics in this example move in a straight line as portrayed by the circles, however, they move somewhat slower than the magnetics since they are not influenced by the forward-acting magnetic force component. By travelling through a number of regions, the magnetic particles will tend to travel a substantial distance from the course of the nonmagnetic particles. On the other hand, the nonmagnetic particles would not be affected by the magnetic field, and would travel in a generally continuous linear fashion as dictated by the forces present other than the magnetic forces. The particular number of regions through which the magnetic material should flow is again a function of a number of the other parameters discussed herein, and it is therefore deemed sufficient that the number be at least a plurality of regions. Preferably the number of regions is greater than about 8, more preferably greater than about 50, and most preferably greater than about 250.

The overall distance of the magnetic pattern through which a magnetic particle must travel is of course again dependent upon the many parameters being discussed, but it is particularly noteworthy that this distance may be virtually unlimited. Hence, unlike all known commercial magnetic separators available, a particle may be subjected to alternating magnetic fields for an inch or a mile or more as required to accomplish this separation. Related to this parameter is the time within which the particles are subjected to the magnetic fields, and again this time can be varied to be extremely brief or quite long. The overall distance travelled through the magnetic fields is dictated by the widths and number of magnetic regions. The time within which the material is to be subjected to the magnetic field should preferably be at least about 0.05 seconds, more preferably at least about 3 seconds, and most preferably at least about 20 seconds.

Another critical parameter in order to accomplish this separation is that the magnetic regions be aligned at an angle other than 90° in the plane of the surface of the regions to the direction of flow of the resultant nonmagnetic force. As is apparent from, for example, FIG. 4, in order for the magnetic forces to physically move magnetic particles at an angle to the direction of flow of the nonmagnetic material, the magnetic field must be aligned at such an angle. Hence, the resultant nonmagnetic force must act in a direction other than in the direction of the magnetic force. The magnetic force acts to produce motion in the plane of the surface of the magnetic segments, and hence the resultant nonmagnetic force may act in any direction with respect to planes other than the plane of the surface of the magnetic segments, or at any direction other than 90° in the plane of the surface of the magnetic segments, the 90° being measured with respect to a line parallel with the length of a given magnetic segment. In other words, the resultant magnetic force acts perpendicular to the length of a magnetic segment, as is shown in FIG. 4C, and therefore the resultant nonmagnetic force must act in some direction other than in the direction of the resultant magnetic force. With respect to planes other than the plane of the surface of the magnetic segments, a force such as wind may be applied from above the surface upon which the material is being processed (or below if the surface is permeable) and a separation can be accomplished since the magnetic particles will still tend to travel in the direction of the resultant magnetic force, as long as the forces are sufficiently balanced so as not to inhibit the separation. Furthermore, more than one nonmagnetic force may simultaneously be applied, and therefore it is the resultant of these forces which is significant. The amount of the angle is again dependent upon the other chosen parameters, and can be made operative at any angle other than 90° in the plane of the surface of the regions to the direction of flow of the resultant nonmagnetic force. In the plane of the magnetic segments, this angle should be, preferably, between plus and minus 85°, more preferably between plus and minus 45°, and most preferably between plus and minus 5°. If the resultant direction of the non-magnetics is outside the plane of the magnetic segments, the two planes should be preferably at an angle of between 5° and 175°, more preferably between 45° and 135°, and most preferably between 85° and 95°.

It is generally preferred that one magnetic region be aligned in parallel fashion to its adjacent magnetic region, although obviously the mechanism of the invention can be accomplished in the absence of this requirement. Indeed, under certain circumstances, it could actually be desirable to maintain a positive angle from the alignment of one magnetic region to its adjacent magnetic region, as this would permit differing collecting forces for the magnetic species being treated. It is therefore preferable that the angle from one magnetic region to its adjacent magnetic region be maintained at less than about 30°, more preferably less than about 15°, and most preferably less than about 5°. With respect to patterns which do not define linear boundaries for the regions, such as for example FIG. 5D, it is, of course, understood that these angular relationships would correspond to the tangent of the curvature of one given segment with respect to the corresponding tangent of its adjacent magnetic segment.

Figure 5A:
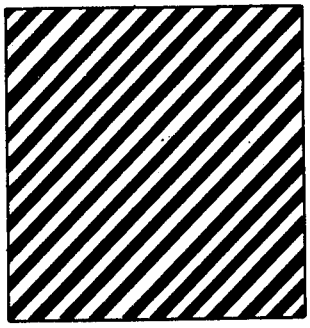
FIGS. 5A through E set forth various patterns for the magnetic regions of the process of the invention.
Figure 5B:
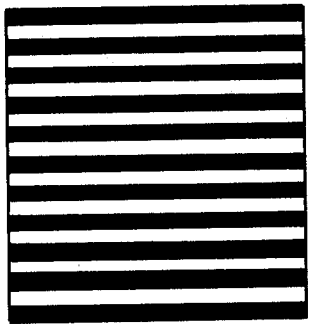
Figure 5C:
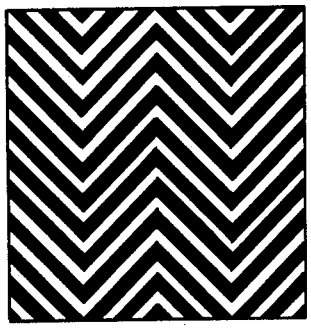
Figure 5D:
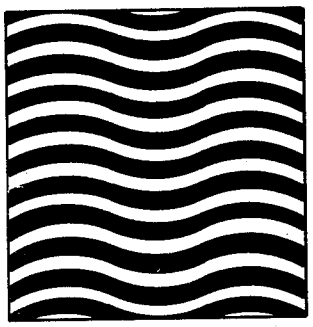
Figure 5E:
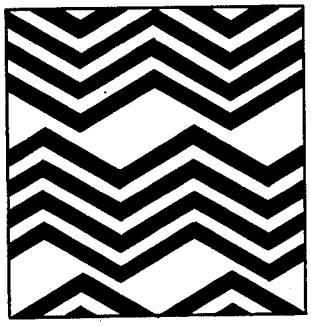
Figure 6:
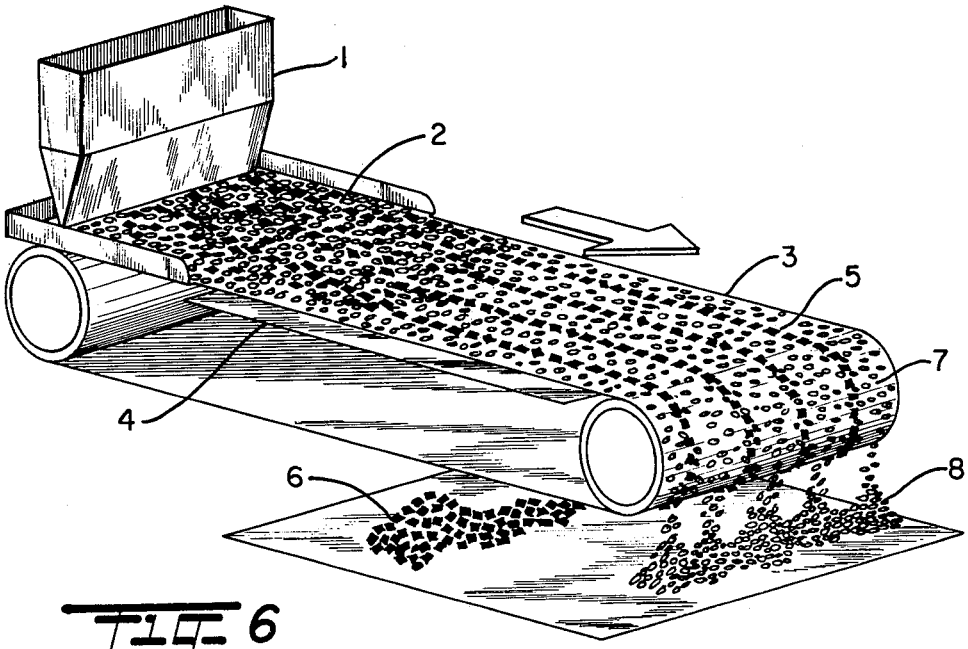
FIG. 6 sets forth an example of a particular apparatus suitable for employing the process of the invention.

Numerous patterns can be devised. The function of the pattern is to accomplish a particular type or pattern of collection of the magnetic particles. For example, the magnetic field produced by a herringbone pattern, the pattern illustrated in FIG. 5C, aligns the magnetics in parallel rows. Placement of magnetics and nonmagnetics in rows permits ample time for the process of disengaging magnetics from nonmagnetics. The distance between rows of magnetic particles is twice the maximum lateral distance magnetic particles should travel. This distance is highly interrelated to the spacing of magnetic and nonmagnetic segments, the angle of the magnetic and nonmagnetic segments to the direction of nonmagnetic travel, and the total length of the magnetic field. Other possible patterns are diagonal, horizontal, sinusoidal, offset herringbone, and others, as illustrated in FIGS. 5A through 5E. These patterns may, of course, repeat within a given magnetic region. The angular relationship of these patterns is, of course, relative to the direction of the resultant nonmagnetic force. One example of a suitable technique for accomplishing the process of the invention is illustrated in FIG. 6, which basically shows a planar conveying sheet passing over a stationary material, which stationary material supports the magnetic pattern. In other words, in this embodiment, the magnetic pattern is mounted in stationary fashion while the material being processed is conveyed over the top of the stationary magnetic pattern by means of a conveyor belt. The pattern employed is that of a herringbone as illustrated in FIG. 5C. The feed material is introduced onto the conveyor belt 3 through feed hopper 1 and feed chute 2, with the conveyor belt travelling over stationary sheet 4 upon which the magnetic regions are mounted. The magnetic particles 5 are aligned in linear fashion as a result of the process of the invention, and the nonmagnetic particles 7 travel between the rows of magnetic particles. As the conveyor belt moves over the drum, the nonmagnetic particles fall from the conveyor belt and are deposited in area 8, and with the drum being magnetic, the magnetic particles adhere to the conveyor belt until they have travelled away from the influence of the magnetic drum and are therefore deposited at area 6. Numerous other techniques would obviously be suitable to accomplish the process of the invention. It is, of course, a requirement that the material being conveyed remain in proximity with the magnetic field in order that the separation may be accomplished. Hence, for example in FIG. 6, it is preferable that the conveyor belt be transported immediately on top of the stationary material supporting the magnetic pattern.

As is shown in FIG. 6, once the magnetic materials have been aligned as a result of the herringbone pattern illustrated therein, a subsequent separation is employed to complete the separation of the magnetics from the nonmagnetics. The technique in FIG. 6 incorporates a magnetic drum as described. Numerous other techniques may be employed to complete the separation, as for example, the arrangement of troughs aligned in accordance with the pattern of the magnetic field in order to segregate the magnetics from the non-magnetics.

EXAMPLES

EXAMPLE 1

A magnetic separator as illustrated in FIG. 6 was built embodying the process of the invention, with a magnetic table of 83 centimeters long and 35 centimeters wide. The magnetic field is comprised of magnetic tape with magnets about 1.2 millimeters wide and space between the magnets of approximately the same width. The magnets are arranged in a herringbone pattern and the repetition of the patterns occurs each 5 centimeters. The segments are aligned at an angle of 45° with respect to the direction of belt travel, and no other resultant nonmagnetic forces are applied. The magnets are arranged with opposite polarities as shown in FIG. 2B, and the field intensity varies from approximately minus 260 to plus 260 oersteds.

A sample of ground magnetite taconite ore was screened to minus 60-mesh; 61.6 percent of the magnetite was liberated, leaving 38.4 percent of the magnetite locked in the gangue. The size distribution of liberated and locked magnetite is as follows:

| Size Distribution - Liberated Magnetite | |
|---|---|
| Range in Microns | % |
| 15–50 | 21.7 |

-continued

| | |
|---|---|
| 50-100 | 25.7 |
| 100-200 | 52.6 |

Size Distribution - Locked Magnetite

| Range in Microns | % |
|---|---|
| 15-50 | 21.7 |
| 50-100 | 26.0 |
| 100-200 | 41.3 |

The number of magnetic regions employed was approximately 260, and the particles of material were processed through the magnetic regions for a time of about 20 seconds. It was noted that, while 260 regions were employed, the magnetic material was essentially linearly separated after the material had passed through about 40 regions.

Results of the separation are as follows:

| | Weight % | Iron % | Magnetite % | Magnetite Distribution, % |
|---|---|---|---|---|
| Magnetic Concentrate | 67.7 | 41.0 | 56.7 | 86.5 |
| Tailings | 32.3 | 13.4 | 18.5 | 13.5 |

(Values for "Magnetite %" are based upon iron analysis and the assumption that all iron present in the samples is as magnetite.)

EXAMPLE 2

Using the apparatus described in Example 1, a sample consisting of 80 grams of minus 48-mesh Ottawa sand and 20 grams of minus 48-mesh commercially prepared pyrrhotite, with some elemental iron, (68.1% iron) were well mixed. The sample was processed through the magnetic separator for about 20 seconds, resulting in three fractions, a concentrate, middling, and tailing. The middling, 1.9 percent of the sample, was reprocessed. It was observed that the magnetic separation was substantially complete after the sample had passed through about 40 regions.

Results of the separation are as follows:

| | Weight % | Iron % | Pyrrhotite % | Pyrrhotite Distribution, % |
|---|---|---|---|---|
| Magnetic Concentrate | 19.2 | 68.0 | 99.8 | 95.9 |
| Tailings | 80.8 | 0.69 | 1.0 | 4.1 |

EXAMPLE 3

Again using the apparatus described in Example 1, a sample consisting of 80 grams of Ottawa sand and 20 grams of natural pentlandite in pyrrhotite was ground and screened to minus 48-mesh and well mixed. The sample was processed through the magnetic separator for about 20 seconds, resulting in three fractions, a concentrate, middling, and tailing. The middling, 3.91 grams, was reprocessed to result in the final product analysis given below. Again, it was observed that substantially complete separation had occurred after the sample had passed through about 40 regions.

| | Weight | Analysis | | Distribution | |
|---|---|---|---|---|---|
| | % | Fe, % | Ni, % | Fe, % | Ni, % |
| Magnetic Concentrate | 11.3 | 58.8 | 2.47 | 72.7 | 35.0 |
| Middling | 1.1 | 42.9 | 14.3 | 4.1 | 12.3 |

-continued

| | Weight | Analysis | | Distribution | |
|---|---|---|---|---|---|
| | % | Fe, % | Ni, % | Fe, % | Ni, % |
| Tailings | 84.6 | 3.18 | 0.628 | 23.2 | 52.7 |

What is claimed is:

1. A process for effecting a magnetic separation of a material comprising a relatively more magnetic material and a relatively less magnetic material comprising passing the material, by means of a nonmagnetic force, through a plurality of regions, each of which comprise a relatively more magnetic segment and an adjacent relatively less magnetic segment having a width of at least 0.05 times the width of the magnetic segment, such that the plurality of regions are arranged so as to comprise alternating relatively more magnetic and relatively less magnetic segments, thereby creating a resultant magnetic force, which regions are aligned at an angle of other than 90° in the plane of the surface of the regions to the direction of the result of nonmagnetic force, and wherein the material being processed is maintained in substantially one plane while being passed through the plurality of regions.

2. The process of claim 1 wherein each region is aligned from 0° to about 30° with respect to each adjacent region.

3. The process of claim 1 wherein a paramagnetic ore is separated from its gangue material.

4. The process of claim 3 wherein the paramagnetic ore is a member selected from the group consisting of magnetite, franklinite, ilmenite, pyrrhotite, zircon, corundum, pyrolusite, columbite, tantalite, marmatite, spinel, garnet, pentlandite, wolframite, monazite, rutile, chromite, manganite, and bastnaesite.

5. The process of claim 1 wherein the relatively more magnetic material is a paramagnetic material selected from the group consisting of compounds of iron, nickel, cobalt, manganese, chromium, cerium, titanium, the rare earth metals, oxygen, and the platinum metals.

6. The process of claim 1 wherein the material being processed is a solid material crushed to a size of no larger than about 10 centimeters.

7. The process of claim 1 wherein the edges of adjacent magnetic segments are of opposite polarity.

8. The process of claim 1 wherein the width of the relatively more magnetic segment is from about 0.01 microns to about 10 centimeters.

9. The process of claim 1 wherein more than one nonmagnetic force is applied to the material being processed.

10. The process of claim 9 wherein the magnetic regions are aligned in a horizontal pattern.

11. The process of claim 1 wherein the magnetic regions are aligned in a herringbone pattern.

12. The process of claim 1 wherein the plurality of regions is at least about 8 regions.

13. The process of claim 1 wherein the plurality of regions is at least about 50 regions.

14. The process of claim 1 wherein the material being processed is subjected to the plurality of regions for at least about 0.05 seconds.

15. The process of claim 1 wherein the material being processed is subjected to the plurality of regions for at least about 3 seconds.

16. The process of claim 1 wherein the regions are aligned at an angle of between plus and minus 85° in the plane of the regions with respect to the direction of the magnetic force.

17. The process of claim 1 wherein the resultant nonmagnetic force has a component as a result of the operation of a conveyor belt.

18. The process of claim 1 wherein the magnetic regions are arranged in a diagonal pattern with respect to the direction of the resultant nonmagnetic force.

19. The process of claim 1 wherein the magnetic regions are arranged in a sinusoidal pattern.

20. The process of claim 1 wherein the width of the relatively nonmagnetic segment is from at least about 0.5 to about 2 times the width of its adjacent magnetic segment.

21. The process for effecting a magnetic separation of a material comprising a relatively more magnetic material and a relatively less magnetic material comprising passing, by a means of a nonmagnetic force, the material through a plurality of regions, the material being processed being maintained physically separated from the surface of the plurality of regions, each of which regions comprise a relatively more magnetic segment and an adjacent relatively less mangetic segment having a width of at least 0.05 times the width of the magnetic segment, such that the plurality of regions are arranged so as to comprise alternating relatively more magnetic and relatively less magnetic segments, thereby creating a resultant magnetic force, which regions are aligned at an angle of other than 90° in the plane of the surface of the regions to the direction of the resultant nonmagnetic force, and wherein the material being processed is maintained in substantially one plane while being passed through the plurality of regions.

22. The process of claim 21 wherein the physical separation is maintained by means of a belt.

23. The process of claim 21 wherein each region is aligned from 0° to about 30° with respect to each adjacent region.

24. The process of claim 21 wherein a paramagnetic ore is separated from its gangue material.

25. The process of claim 24 wherein the paramagnetic ore is a member selected from the group consisting of magnetite, franklinite, ilmenite, pyrrhotite, zircon, corundum, pyrolusite, columbite, tantalite, marmatite, spinel, garnet, pentlandite, wolframite, monazite, rutile, chromite, manganite, and bastnaesite.

26. The process of claim 21 wherein the relatively more magnetic material is a paramagnetic material selected from the group consisting of compounds of iron, nickel, cobalt, manganese, chromium, cerium, titanium, the rare earth metals, oxygen, and the platinum metals.

27. The process of claim 21 wherein the material being processed is a solid material crushed to a size of no larger than about 10 centimeters.

28. The process of claim 21 wherein the edges of adjacent magnetic segments are of opposite polarity.

29. The process of claim 21 wherein the width of the relatively more magnetic segment is from about 0.01 microns to about 10 centimeters.

30. The process of claim 29 wherein the width of the relatively less magnetic segment is from at least about 0.5 to about 2 times the width of its adjacent magnetic segment.

31. The process of claim 21 wherein more than one nonmagnetic force is applied to the material being processed.

32. The process of claim 31 wherein the magnetic regions are aligned in a horizontal pattern.

33. The process of claim 21 wherein the plurality of regions is at least about 8 regions.

34. The process of claim 21 wherein the plurality of regions is at least about 50 regions.

35. The process of claim 21 wherein the material being processed is subjected to the plurality of regions for at least about 0.05 seconds.

36. The process of claim 21 wherein the material being processed is subjected to the plurality of regions for at least about 3 seconds.

37. The process of claim 21 wherein the regions are aligned at an angle of between plus and minus 85° in the plane of the regions with respect to the direction of the magnetic force.

38. The process of claim 21 wherein the resultant nonmagnetic force has a component as a result of the operation of a conveyor belt.

39. The process of claim 21 wherein the magnetic regions are arranged in a diagonal pattern with respect to the direction of the resultant nonmagnetic force.

40. The process of claim 21 wherein the magnetic regions are arranged in a sinusoidal pattern.

41. The process of claim 21 wherein the magnetic regions are aligned in a herringbone pattern.

42. A process for effecting a magnetic separation of a material comprising a relatively more magnetic material and a relatively less magnetic material comprising passing the material, by means of a nonmagnetic force, through a plurality of regions, each of which comprise a relatively more magnetic segment and an adjacent relatively less magnetic segment having a width of at least 0.05 times the width of the magnetic segment, such that the plurality of regions are arranged so as to comprise alternating relatively more magnetic and relatively less magnetic segments, thereby creating a resultant magnetic force, which regions are aligned at an angle of other than 90° in the plane of the surface of the regions to the direction of the resultant nonmagnetic force, and wherein the material being processed is maintained in substantially one plane while being passed through the plurality of regions, thereby deflecting the relatively more magnetic material relative to the relatively less magnetic material while the materials continue to pass through the plurality of regions.

43. The process of claim 42 wherein the magnetic regions are arranged in a sinusoidal pattern.

44. The process of claim 42 wherein more than one nonmagnetic force is applied to the material being processed.

45. The process of claim 44 wherein the magnetic regions are aligned in a horizontal pattern.

46. The process of claim 42 wherein the physical separation is maintained by means of a belt.

47. The process of claim 42 wherein each region is aligned from 0° to about 30° with respect to each adjacent region.

48. The process of claim 42 wherein a paramagnetic ore is separated from its gangue material.

49. The process of claim 42 wherein the paramagnetic ore is a member selected from the group consisting of magnetite, franklinite, ilmenite, pyrrhotite, zircon, corundum, pyrolusite, columbite, tantalite, marmatite, spinel, garnet, pentlandite, wolframite, monazite, rutile, chromite, manganite, and bastnaesite.

50. The process of claim 42 wherein the relatively more magnetic material is a paramagnetic material selected from the group consisting of compounds of iron, nickel, cobalt, manganese, chromium, cerium, titanium, the rare earth metals, oxygen, and the platinum metals.

51. The process of claim 42 wherein the edges of adjacent magnetic segments are of opposite polarity.

52. The process of claim 42 wherein the width of the relatively more magnetic segment is from about 0.01 microns to about 10 centimeters.

53. The process of claim 52 wherein the width of the relatively less magnetic segment is at least about 0.5 to about two times the width of its adjacent magnetic segment.

54. The process of claim 42 wherein the magnetic regions are aligned in a herringbone pattern.

55. The process of claim 42 wherein the plurality of regions is at least about 8 regions.

56. The process of claim 42 wherein the plurality of regions is at least about 50 regions.

57. The process of claim 42 wherein the material being processed is subjected to the plurality of regions for at least about 0.05 seconds.

58. The process of claim 42 wherein the material being processed is subjected to the plurality of regions for at least about 3 seconds.

59. The process of claim 42 wherein the regions are lined at an angle of between plus and minus 85° in the plane of the regions with respect to the direction of the magnetic force.

60. The process of claim 42 wherein the resultant nonmagnetic force has a component as a result of the operation of a conveyor belt.

61. The process of claim 42 wherein the magnetic regions are arranged in a diagonal pattern with respect to the direction of the resultant nonmagnetic force.

62. A process for effecting a magnetic separation of material comprising a relatively more magnetic material and a relatively less magnetic material comprising passing the material, by a means of a nonmagnetic force, through a plurality of regions, the material being processed being maintained physically separated from the surface of the plurality of regions, each of which regions comprise a relatively more magnetic segment and an adjacent relatively less magnetic segment having a width of at least 0.05 times the width of the magnetic segment, such that the plurality of regions are arranged so as to comprise alternating relatively more magnetic and relatively less magnetic segments, thereby creating a resultant magnetic force, which regions are aligned at an angle of other than 90° in the plane of the surface of the regions to the direction of the resultant nonmagnetic force, and wherein the material is maintained in substantially one plane while being passed through the plurality of regions, thereby deflecting the relatively more magnetic material relative to the relatively less magnetic material while the materials continue to pass through the plurality of regions.

63. The process of claim 62 wherein more than one nonmagnetic force is applied to the material being processed.

64. The process of claim 63 wherein the magnetic regions are aligned in a horizontal pattern.

65. The process of claim 62 wherein the physical separation is maintained by means of a belt.

66. The process of claim 62 wherein each region is aligned from 0° to about 30° with respect to each adjacent region.

67. The process of claim 62 wherein a paramagnetic ore is separated from its gangue material.

68. The process of claim 62 wherein the paramagnetic ore is a member selected from the group consisting of magnetite, franklinite, ilmenite, pyrrhotite, zircon, corundum, pyrolusite, columbite, tantalite, marmatite, spinel, garnet, pentlandite, wolframite, monazite, rutile, chromite, manganite, and bastnaesite.

69. The process of claim 62 wherein the relatively more magnetic material is a paramagnetic material selected from the group consisting of compounds of iron, nickel, cobalt, manganese, chromium, cerium, titanium, the rare earth metals, oxygen, and the platinum metals.

70. The process of claim 62 wherein the edges of adjacent magnetic segments are of opposite polarity.

71. The process of claim 62 wherein the width of the relatively more magnetic segment is from about 0.01 microns to about 10 centimeters.

72. The process of claim 71 wherein the width of the relatively less magnetic segment is at least about 0.5 to about two times the width of its adjacent magnetic segment.

73. The process of claim 62 wherein the magnetic regions are aligned in a herringbone pattern.

74. The process of claim 62 wherein the plurality of regions is at least about 8 regions.

75. The process of claim 62 wherein the plurality of regions is at least about 50 regions.

76. The process of claim 62 wherein the material being processed is subjected to the plurality of regions for at least about 0.05 seconds.

77. The process of claim 62 wherein the material being processed is subjected to the plurality of regions for at least about 3 seconds.

78. The process of claim 62 wherein the regions are lined at an angle of between plus and minus 85° in the plane of the regions with respect to the direction of the magnetic force.

79. The process of claim 62 wherein the resultant nonmagnetic force has a component as a result of the operation of a conveyor belt.

80. The process of claim 62 wherein the magnetic regions are arranged in a diagonal pattern with respect to the direction of the resultant nonmagnetic force.

81. The process of claim 62 wherein the magnetic regions are arranged in a sinusoidal pattern.

* * * * *